United States Patent [19]

Rikker

[11] 4,368,984

[45] Jan. 18, 1983

[54] MIXER APPARATUS

[75] Inventor: Leslie D. Rikker, Oak Forest, Ill.

[73] Assignee: National Engineering Company, Chicago, Ill.

[21] Appl. No.: 859,329

[22] Filed: Dec. 12, 1977

[51] Int. Cl.[3] ..... B28C 5/00; B01F 7/20; B01F 15/02

[52] U.S. Cl. ..... 366/15; 366/16; 366/65; 366/67; 366/172; 366/173; 366/311; 366/312

[58] Field of Search ..... 366/10, 11, 13, 15, 366/40, 65, 66, 91, 98, 167–169, 177, 180, 181, 183, 241, 279, 290, 311, 292–296, 16, 67, 172, 173, 312; 198/587

[56] References Cited

U.S. PATENT DOCUMENTS

| | | | |
|---|---|---|---|
| 1,292,141 | 1/1919 | Swigert | 366/311 |
| 1,335,642 | 3/1920 | Beardsley et al. | 198/587 |
| 3,606,271 | 9/1971 | Schmidt et al. | 366/177 |
| 3,637,191 | 1/1972 | Abraham | 366/15 |
| 3,773,299 | 11/1973 | Rebish | 366/169 |
| 3,804,303 | 4/1974 | Fassauer | 366/183 |
| 3,934,858 | 1/1976 | Parsonage et al. | 366/309 |

*Primary Examiner*—Philip R. Coe
*Assistant Examiner*—Timothy F. Simone
*Attorney, Agent, or Firm*—Mason, Kolehmainen, Rathburn & Wyss

[57] ABSTRACT

A new and improved mixer apparatus is especially adapted for use in a program controlled system for making foundry molds and includes a mixing device for dispensing a mixture of molding sand and binder onto a mold forming pattern in a flask. The device includes a mixing chamber having an inlet for receiving sand adjacent an upper level and a discharge outlet for dispensing a mixture adjacent a lower level. A rotor is mounted on a central axis of the chamber and includes an elongated shaft extending between the inlet and outlet. A flow metering unit divides the chamber into upper and lower sections and is operable for controlling the flow rate of material toward the discharge outlet. The rotor includes upper and lower sets of blades pivotally mounted on axes parallel and spaced radially outwardly of the central axis of the chamber. These blades include free outer edges extending along and in close proximity with adjacent inside wall surfaces of the upper and lower chamber sections and these blades interact with the chamber wall surfaces forcefully moving and mixing the sand/binder mixture around the surface of the chamber wall outwardly against the same with a spatula-type mixing action. The binder system for the molding sand includes at least two components which are introduced into the respective upper and lower chamber sections in order to provide thorough intermixing and pre-mixing of the materials so that high quality molding sand is ready to be dispensed onto a mold forming pattern as it leaves the outlet of the mixing chamber.

24 Claims, 11 Drawing Figures

FIG. 6
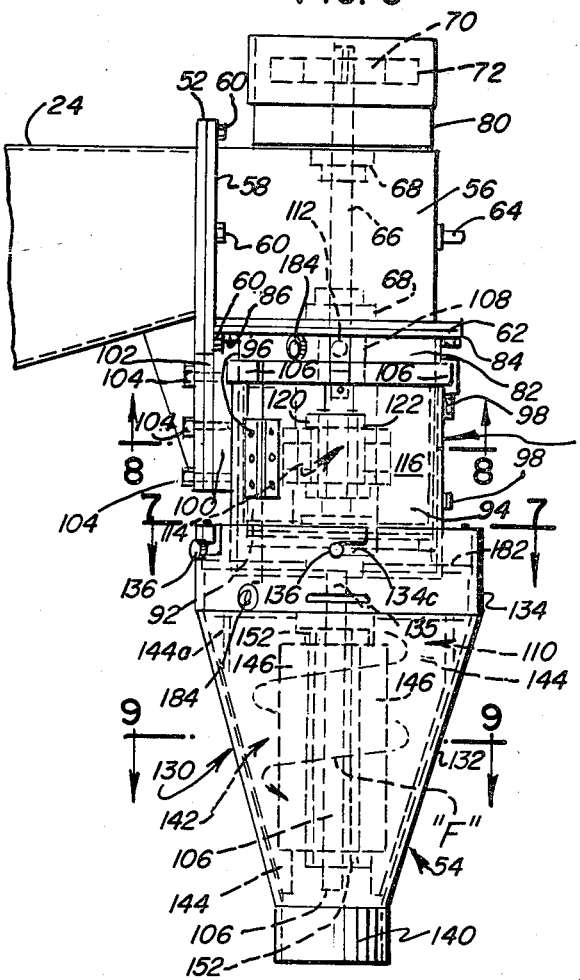
FIG. 5
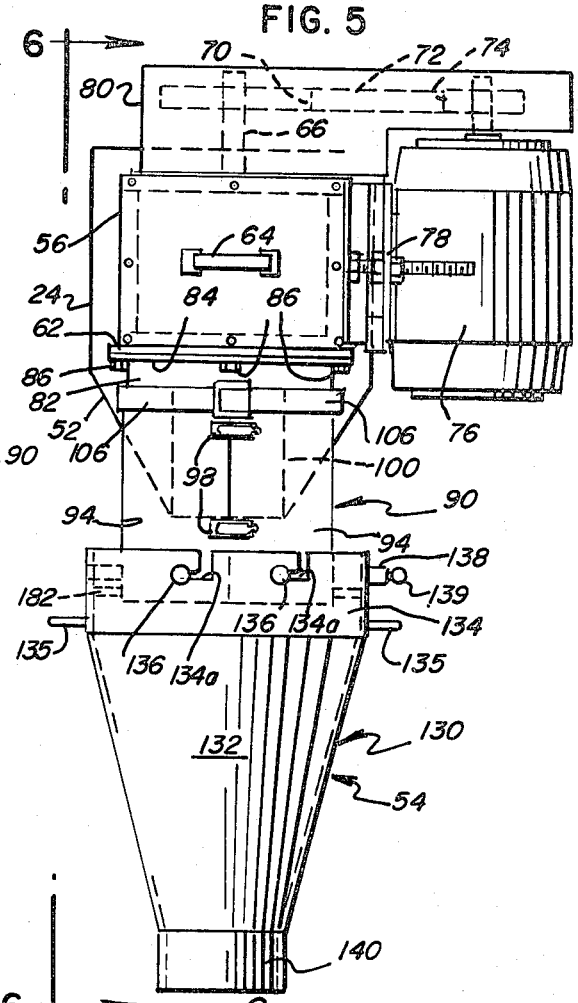
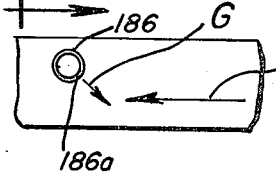
FIG. 7a
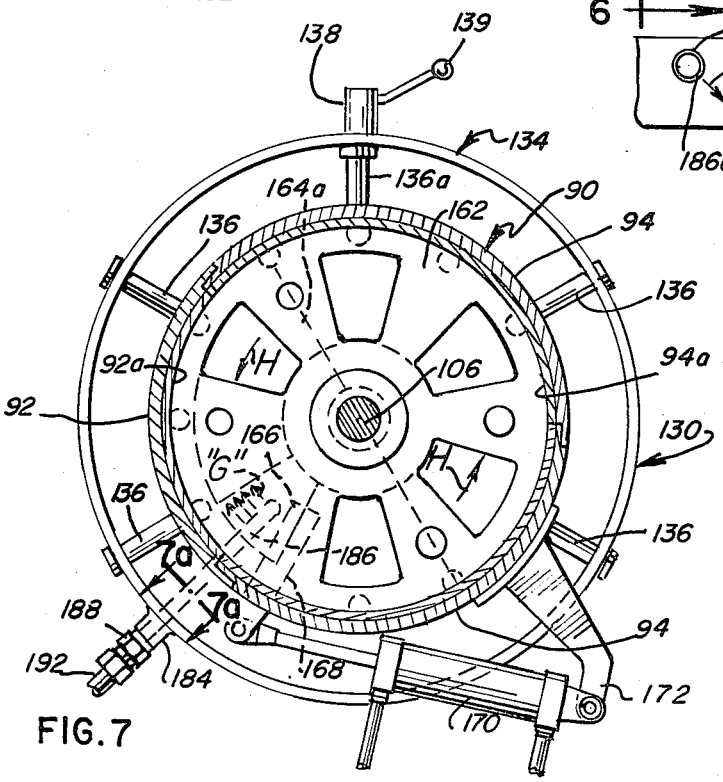
FIG. 7
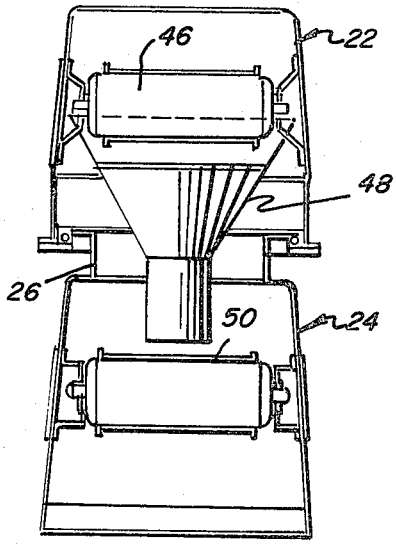
FIG. 2

MIXER APPARATUS

BACKGROUND OF THE INVENTION

1. Field of the Invention

The mixing apparatus of the present invention is especially adapted for use in a program controlled automatic mold making system such as that disclosed and claimed in the copending United States Patent Application Ser. No. 731,930, filed Oct. 13, 1976, entitled METHOD AND APPARATUS FOR MAKING MOLDS, which application is assigned to the same assignee as the present invention, which issued Oct. 24, 1978 as U.S. Pat. No. 4,121,646. More particularly, the mixing apparatus of the present invention is an improvement over the mixing apparatus disclosed in the aforesaid copending application and provides for precision control of the mixing and dispensing process in making sand molds.

2. Description of the Prior Art

A wide variety of mixing machines have been developed to provide resin bound foundry sand for mold making in foundries and the like. U.S. Pat. Nos. 3,773,299; 3,850,413 and 3,881,703 disclose foundry said mixing machines wherein two components of a resinous binder system are centrifuged outwardly against a curtain of flowing sand. U.S. Pat. Nos. 3,934,858; 3,943,991; 3,946,796; 3,994,332; 3,995,837; 3,998,260; 3,999,592; 4,000,770 and 4,039,169 disclose mixing systems wherein molding sand and binder is premixed and separately molding sand and a catalyst is also premixed. These two premixed mixtures are then mixed together just prior to delivery into the mold flask. Various other types of foundry sand and material blending machines are disclosed in U.S. Pat. Nos. 3,158,358; 3,917,235; 3,929,230; 3,964,732; 3,983,923 and 4,004,782. Some of these mixing devices employ rotating elements mounted for rotation about a vertical axes while others employ horizontal rotors.

It is an object of the present invention to provide a new and improved mixing apparatus for dispensing a mixture of molding said and binder onto a mold forming pattern.

It is another object of the invention to provide a new and improved mixing apparatus for the character described which is especially well adapted for use in a program controlled automatic mold making system.

More particularly, it is an object of the present invention to provide a new and improved mixing apparatus of the character described which is simple in construction and operation and which provides for easy servicing and maintenance.

Another object of the present invention is to provide a new and improved mixing apparatus of the character described which includes a mixing chamber divided into upper and lower sections wherein the flow of sand is intermixed with one component of a binder system in an upper chamber and a second component of the binder system is introduced into the lower section followed by a thorough mixing of all materials together before discharge from the mixing chamber into a mold flask.

Another object of the present invention is to provide a new and improved mixing apparatus of the character described including novel injector means for insuring better mixing of the components of the binder system and the sand in the mixing chamber.

Still another object of the invention is to provide a novel mixing apparatus having a mixing chamber which can be easily opened for clean out and which provides for ready removal of the rotor assembly when required.

SUMMARY OF THE INVENTION

The foregoing and other objects and advantages of the present invention are accomplished in a new and improved mixing apparatus especially adapted for dispensing a mixture of molding sand and binder onto a mold forming pattern in foundries and the like. The apparatus is particularly well suited for use in the program controlled mold making system of the type described and shown in the aforementioned U.S. copending patent application and includes a vertical flow mixing chamber having an inlet for receiving sand adjacent an upper level and a discharge outlet at the lower end for dispensing the mixture onto a pattern in a mold flask or the like. The rotor is mounted on a central axis of the mixing chamber and includes an elongated shaft detachably connected to an upper drive shaft and extending downwardly between the inlet and outlet ends of the chamber. A novel metering system is provided and divides the chamber into upper and lower sections and the metering system provides precision control of the flow rate of finished material from the discharged outlet. The rotor includes upper and lower sets of blades, which blades are pivotally mounted on axes parallel and spaced radially and outward of the shaft axis. These blades include free outer edges extending along and in close proximity to adjacent inside wall surfaces of the upper and lower sections of the chamber so that as the blades move around the chamber walls, the material is forced outwardly against the wall surface in a spatula-type mixing action which insures thorough mixing of the sand and binder. One component of the resin binder system is introduced into the upper chamber section through a specially designed nozzle system spaced above the upper set of blades and a second component of the binder system is introduced into the upper level of the lower chamber section above the lower blade set to complete the introduction of the binding materials and provide for thorough intermixing with the sand before discharge out the lower end of the mixing chamber. The mixing chamber can be opened up and the lower portion is detachable for easy cleaning, and when opened up, the rotor system is exposed and is also readily removed for cleaning and/or maintenance. These functions can be accomplished easily and rapidly at the end of a work whift, for example.

BRIEF DESCRIPTION OF THE DRAWINGS

For a better understanding of the invention, reference should be had to the following detailed description taken in conjunction with the drawings, in which:

FIG. 2 is a transverse, sectional view taken substantially along lines 2—2 of FIG. 1;

FIG. 5 is an enlarged outer end elevational view looking in the direction of the arrows 5—5 of FIG. 1;

FIG. 6 is a side elevational view looking in the direction of arrows 6—6 of FIG. 5;

FIG. 7 is a horizontal cross-sectional view taken substantially along lines 7—7 of FIG. 6;

FIG. 7*a* is a fragmentary, vertical sectional view taken substantially along lines 7*a*—7*a* of FIG. 7;

DESCRIPTION OF THE PREFERRED EMBODIMENT

Figures 1, 3, 4, 8, 9:
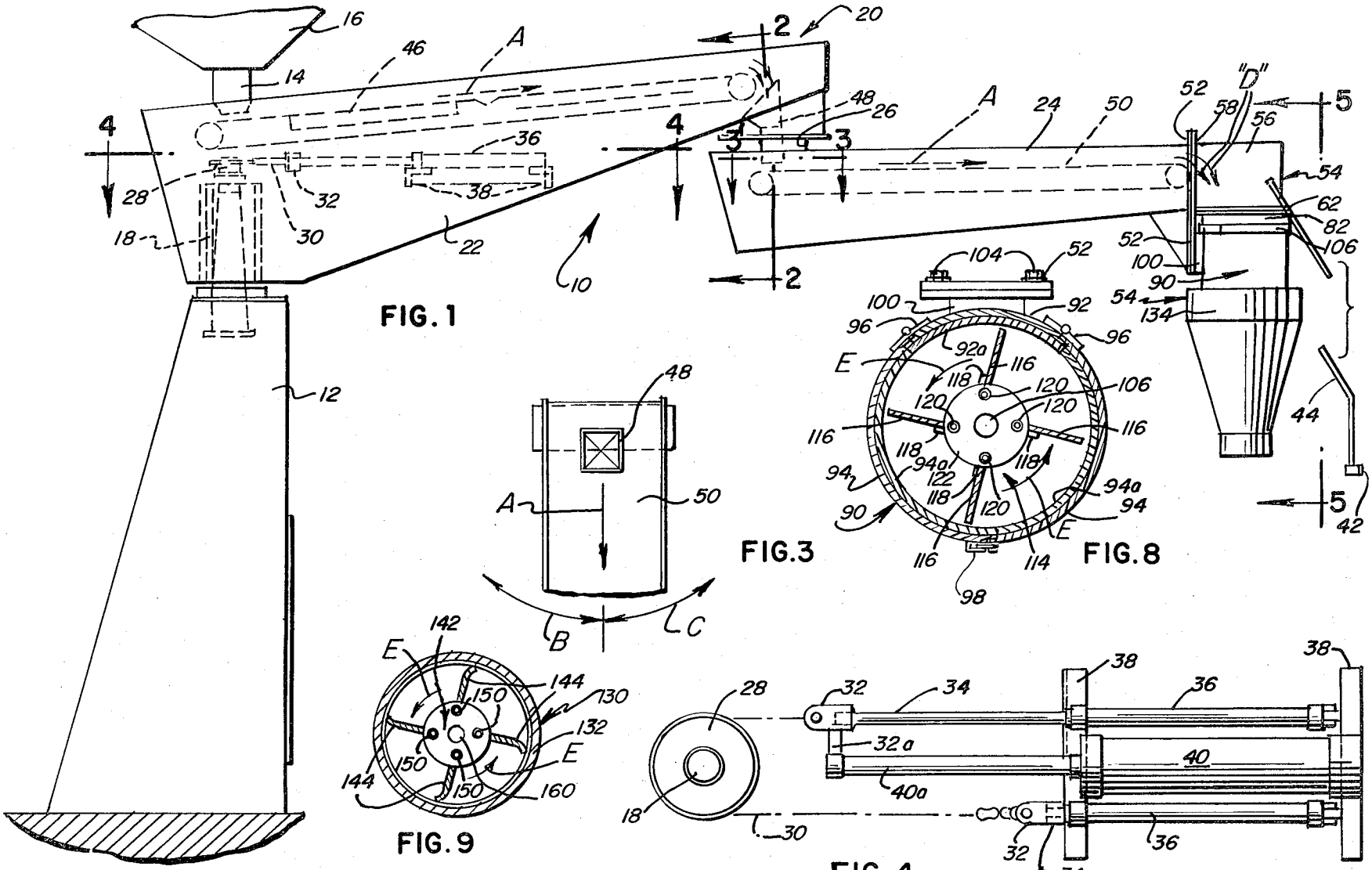
FIG. 1 is a side elevational view of a new and improved mixing apparatus constructed in accordance with the features of the present invention.
FIG. 3 is a horizontal, sectional view taken substantially along lines 3—3 of FIG. 1.
FIG. 4 is a horizontal, sectional view taken substantially along lines 4—4 of FIG. 1.
FIG. 8 is a transverse, horizontal sectional view taken substantially along lines 8—8 of FIG. 6.
FIG. 9 is a transverse, horizontal sectional view taken substantially along lines 9—9 of FIG. 6.

Referring now more particularly to the drawings, therein is illustrated a new and improved mixing apparatus 10 especially well adapted for use in a program controlled mold making system as disclosed in the aforementioned copending United States Patent Application. The apparatus includes an upstanding support pedestal 12 positioned below the discharge outlet 14 of a hopper 16 containing a supply of preconditioned foundry sand. The support pedestal is provided with an upstanding shaft 18 at the upper end which supports the inner end of an articulated arm assembly 20 extending outwardly of the pedestal in a generally radial direction. The arm assembly 20 includes an inner arm section 22 and an outer arm section 24 which are pivotally interconnected by a circular bearing sleeve 26 which permits the inner and outer sections to pivot freely with respect to one another.

The inner arm 22 is pivotal on the support shaft 18 and control of the pivotal movement is provided as shown in FIGS. 1 and 4 by means of a gear or sprocket 28 secured to the shaft 18 and a roller chain 30 entrained around the periphery and connected at its opposite outer ends by means of clevises 32 to a pair of guide rods 34 which are slideably disposed in guide cylinders 36 extending between a pair of transverse support brackers 38 in the inner arm section. One of the clevises 32 is connected by a bracket **32*a* to move with the outer end of a piston rod 40*a* of a hydraulic or pneumatic control cylinder 40**.

As viewed in FIG. 4, when the piston rod **40*a* is retracted into the cylinder, the upper clevis 32 and the upper run of the roller chain moves toward the brackets 38 transversely of the arm and this causes the arm to pivot in a clockwise direction about the gear 28. Outward movement of the piston rod in the cylinder causes the arm 22 to pivot in a counterclockwise direction. A control valve 42 on an arm 44 is provided for handy control of the flow of fluid into the opposite ends of the cylinder 40** to provide the desired direction of arm movement.

The inner arm section 22 of the articulated arm assembly 20 includes an endless belt conveyor 46 mounted within the body or housing of the arm and molding sand is discharged from the outlet 14 of the hopper 16 onto the inner end of the upper run of the belt conveyor. At the outer end, the belt conveyor discharges sand into a hopper at the upper end of a chute 48, which in turn delivers the sand to the upper run of a belt conveyor 50 mounted in the outer arm segment 24 within the housing structure thereof. The lower or discharge end of the hopper and chute 48 is centered with respect to the pivotal axis of interconnection between the inner and outer arm segments 22 and 24 and, as shown in FIG. 3, the sand moves outwardly along the lower belt conveyor 50 in the direction of the arrow "A" regardless of the angle of pivotal interconnection between the inner and outer arms as indicated by the arrows "B" and "C" extending in opposite directions from the center line of the belt conveyor.

At the outer end, the arm 24 is provided with a vertical flange plate 52 which is adapted to support the upper end portion of a mixing head assembly constructed in accordance with the features of the present invention and referred to generally by the reference numeral 54. The mixing head assembly includes an upper, box-shaped inlet section 56 having a vertical inlet flange 58 secured to the flange 52 with cap screws 60. Sand from the belt conveyor 50 flows outwardly and downwardly into the inlet section 56 as indicated by the arrow "D" (FIG. 1) and gravitates downwardly through an open, flanged lower end 62 into the next lower portion of the mixing head assembly 54. A handle 64 is provided on the outer end of the inlet section to facilitate manual movement of the entire mixing head assembly as desired.

A vertical drive shaft 66 is centrally positioned in the inlet section 56 and includes a lower end portion extending downwardly and below the lower flange 62. The drive shaft is supported on suitable bearings 68 and extends upwardly through a wall of the inlet section as shown in FIGS. 5 and 6. At the upper end, the drive shaft is provided with a pulley or sheave 70 which is driven by an endless belt 72 from a drive pulley 74 on the output shaft of an electric gear motor 76. The gear motor 76 is mounted on an adjustable motor base 78 carried on one side wall of the inlet section 56 as shown in FIG. 5. A guard or belt enclosure 80 is provided to enclose and cover the belt drive assembly between the motor and the mixing chamber drive shaft.

Figure 10:
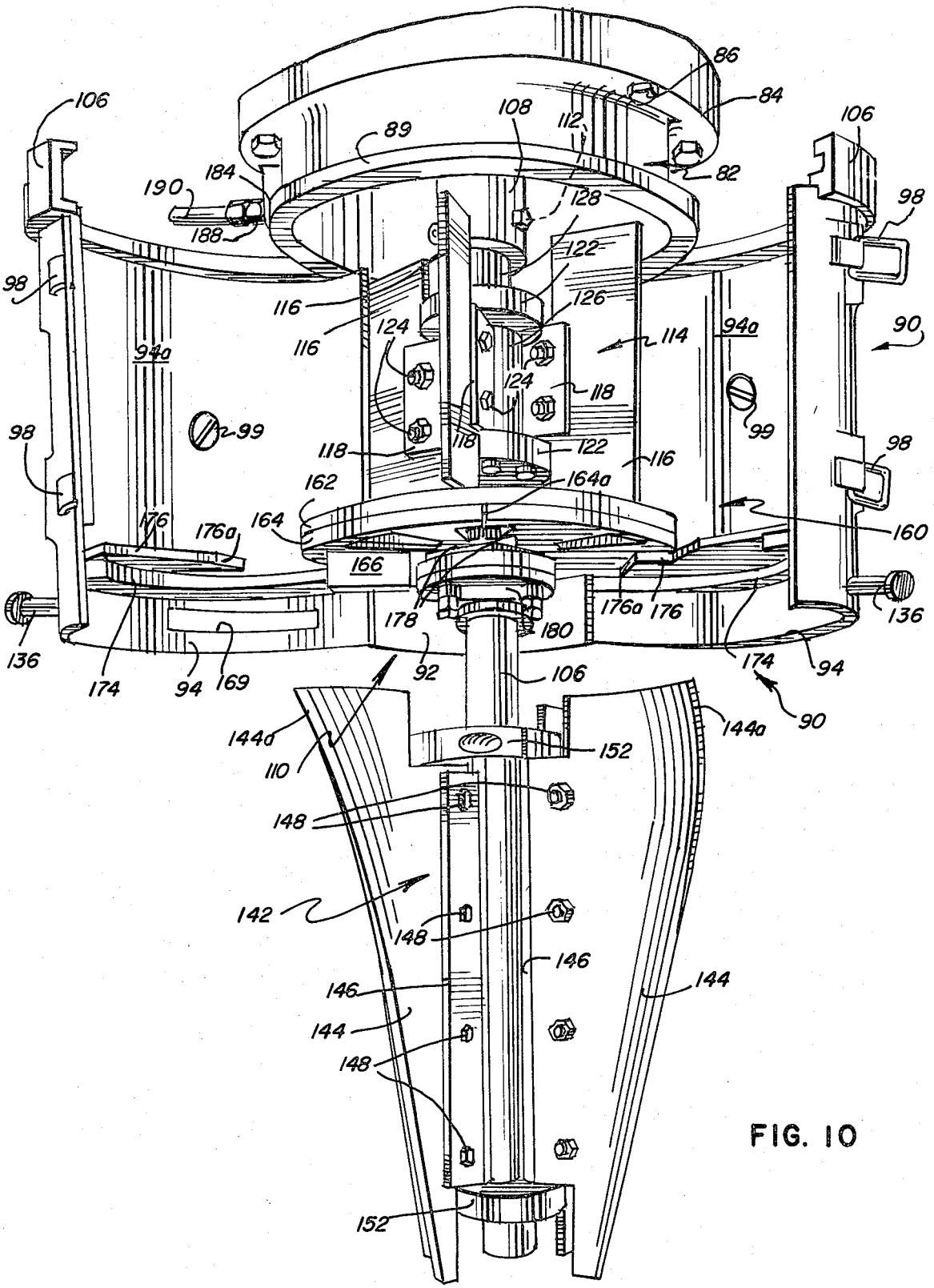
FIG. 10 is a perspective elevational view of the mixing chamber in accordance with the present invention shown with the upper chamber segment in a fully open condition and with the lower chamber segment detached and removed exposing the rotor assembly and interior details of the mixing chamber.

In accordance with the present invention, the lower portion of the mixing chamber assembly 54 is supported from the lower flange 52 of the inlet section 56 by means of a generally cylindrical, transition section 82 having an outwardly extending annular flange 84 formed at the upper end and bolted to the flange 62 by means of cap screws 86. The cylindrical transition section 82 also encloses an annular, outwardly extending lower end flange 89 (FIG. 10) which cooperates to provide a seal with the next lower portion of the mixing chamber assembly. As best shown in FIGS. 5 and 10, the mixing apparatus of the present invention includes a generally cylindrical upper chamber 90 in coaxial alignment with the transition section 82 and the drive shaft 66. The upper chamber is formed with an outer sidewall provided by a fixed arcuate back wall segment 92 and a pair of movable arcuate forward or side wall segments 94 which are hingedly attached to the back wall by hinges 96. As best shown in FIG. 7, the vertical joint lines between the back wall segment 92 and the movable front segments 94 are formed with a shiplap type joint to provide an effective seal for preventing the sand from escaping when the segments are closed and held together in a latched position as shown in FIGS. 5, 6 and 7 by means of a pair of latch assemblies 98. These latches are vertically spaced along the frontal joint line between the hinged movable wall segment 94 as shown best in FIGS. 5 and 10. Each of the chamber wall segments 92 and 94 of the upper chamber is provided with a replaceable inner liner **92*a* and 94*a*, respectively, formed of "NYLON" or other suitable wear-resistant plastic material and these liners are secured in place on their respective wall segments by means of flush-type counter-sunk head cap screws 99 as shown in FIG. 10. Accordingly, removal and replacement of the liners is rapid and easy whenever the upper chamber 90 is opened up as shown in FIG. 10**.

The back wall segment 92 is supported from the outer end flange 52 of the outer arm section 24 by means of a support block 100 having a flange 102 secured to the flange 52 by means of cap screws 104 as shown in FIGS. 6 and 8. As best illustrated in FIG. 10, the upper edges of the wall segments 92 and 94 of the upper chamber 90 are formed with inwardly grooved, enlarged upper end flange portions 106 which move into annular sealing relation with the lower annular flange 90 on the transition section 82 when the wall segments 94 are closed together to close the upper chamber 90 as shown in FIGS. 5, 6, 7 and 8. A tight seal is then provided between the lower end of the transition section 82 and the upper end of the upper chamber 90.

In accordance with the invention, the drive shaft 66 is connected to a depending, coaxial rotor shaft 106 by a detachable annular coupling 108 so that the entire rotor assembly which is indicated generally by the reference numeral 110 may be readily detached from the upper drive shaft when the upper chamber 90 is opened. As illustrated, the coupling 108 is provided with a cross pin 112 which extends through a transverse opening in the rotor shaft or the drive shaft so that whenever the pin is removed, the drive shaft and rotor shaft can be decoupled from one another.

In accordance with the invention, the rotor assembly 110 includes an upper blade assembly 114 having a set of blades 116, each blade extending radially outwardly of the rotor shaft in a diverse direction. Each blade is freely pivotal and has a vertically extending free outer edge adapted to move in close proximity (for example, $\frac{1}{8}''$ to $\frac{1}{4}''$) with respect to the inner surfaces of the adjacent chamber wall liners 92*a* and 94*a*. As best shown in FIG. 10, each upper blade 116 is removably attached to hinge-like blade support member 118 so that the blade can be readily removed and/or replaced when necessary. The blade support members are pivotally mounted on a plurality of blade support pins 120 spaced equilaterally around the central rotor shaft 106 and outwardly parallel thereof. These blade support pins are secured at their upper and lower ends by a pair of spaced apart split type collars 122 which are in turn removably attached to the rotor shaft and are tightened thereon by means of set screws (not shown). Each blade 116 is secured to its respective hinge-like support by a pair of removable nut and bolts 124 as shown in FIG. 10 so that removal and replacement of the blades 116 can be rapidly accomplished once the chamber wall segments 94 are opened up as shown in FIG. 10. Referring to FIG. 8, when the rotor assembly is driven in a counterclockwise direction as indicated by the arrow "E", the free outer edges of the vertical blades 116 move and sweep around in close proximity to the inside wall surface of the wall liners 92*a* and 94*a* of the upper chamber 90 and this causes the sand to be centrifuged outwardly in a thin annulus around the outer portion of the chamber with the blades providing a spatula-type mixing action, as will be described hereinafter in more detail. The hinge-like blade support elements 118 are retained in freely pivotal mounting on the pins 120 which the collars 122 maintained in the desired spaced apart relation on the rotor shaft by means of a central spacing sleeve 126 as shown in FIG. 10. Similarly, a spacing sleeve 128 may be provided between the upper collar 122 and the lower end of the coupling unit 108.

In accordance with the present invention, the mixing apparatus includes a lower chamber 130 mounted in coaxial alignment with the upper chamber 90 and formed with a generally frusto-conical shaped outer shell 132 intermediate the upper and lower ends. The shell is made of "NYLON" or other wear-resistant plastic material and is detachably supported from the upper chamber 90. For this purpose, the lower chamber is provided with an integrally formed, generally cylindrical, upper end portion 134 having a plurality of L-shaped grooves 134*a* at radially spaced apart locations opening onto the upper edge. The grooves 134*a* are adapted to accommodate support pins 136 having enlarged heads at their outer ends and projecting radially outwardly from the outer surface of the wall segments of the lower end portion of the upper chamber 90. When the movable wall segments 94 have been closed together and latched as shown in FIGS. 5 and 6, the lower chamber 130 may be attached thereto by moving the lower chamber upwardly in coaxial alignment with the vertical portions of the L-shaped grooves 134*a* aligned with the respective headed pins 136 radiating outwardly from the walls of the upper chamber 90. Once the pins are bottomed against the lower edges of the grooves, the lower chamber 130 is then rotated relative thereto until the pins are seated against the blind ends of the horizontal sections of the grooves as shown in FIG. 5. After this position is attained, a locking sleeve 138 is tightened onto a threaded outer end portion of a principal key pin 136*a* (FIG. 7) by means of a handle and knob 139. Tightening of the sleeve prevents reverse relative rotation of the conical lower chamber 130 after it has been installed in position as described. Removal and detachment of the lower chamber from the upper chamber is achieved by reversing the process just described. The lower chamber is formed with a cylindrical discharge outlet 140 of reduced diameter at the lower end of this provides a nozzle for a high concentrated stream of finished material for directionalized delivery into a mold flask.

In accordance with the invention, the lower frusto-conical mixing chamber 130 is provided with lower blade assembly 142 which includes a set of vertical blades 144 having reverse curved upper end portions 144*a* which provide for better smearing or spatula-type mixing action for moving the material against the inside surface of the frusto-conically sloped section 132 of the lower chamber. Each blade is detachably supported on a hinge-like support member 146 by a plurality of nut and bolt fasteners 148 spaced longitudinally along an inside portion of the blade. The hinge-like blade supports 146 are mounted for free pivotal movement on longitudinal hinge pins 150 (FIG. 9) extending between a pair of spaced apart, split-type, shaft collars 152 similar to the collars 122 of the upper blade assembly and adapted to be tightened onto the shaft 106 by internal set screws. As the lower blade assembly 142 rotates around the lower chamber section in a clockwise direction as indicated by the arrows "E" in FIG. 9, the material is centrifuged outwardly along the frustro-conical inner surface of the conical section 132 and moves slowly downwardly towards the discharge end in a spiral path as indicated by the dotted arrows "F" in FIG. 6. Like the upper blades 116, the lower blades 144 are also provided with freely movable outer edges which are spaced closely to the inside surface of the frusto-conical chamber wall section 32 so that the material is pushed outwardly against the wall in a spatula-like intense mixing action. This type of mixing action insures that excellent dispersion of the binder constituents throughout the molding sand will be achieved before the finished mixture is discharged out nozzle section 140 at the lower end of the mixing head assembly. Because the blades 116 and 144 are freely pivotal on their mounting pins, the outer edges thereof tend to move outwardly toward the confining walls as close as the sand mixture that is present will permit when the rotor shaft 106 is turning.

In accordance with the present invention, the upper and lower chambers 90 and 130, respectively, are separated by means of a metering system generally indicated by the reference numeral 160. The metering system includes a pair of upper and lower coaxially aligned, step mounted metering plates 162 and 164, respectively, and each plate has a plurality of generally trapezoidal shaped, radial openings spaced outwardly around the central aperture of the plate which accommodates the rotor shaft 106 as best shown in FIGS. 7 and 10. The upper and lower plates are relatively rotatable with respect to one another about the rotor shaft 106 so that the trapezoidal openings therein move between a maximum flow position wherein the openings are directly aligned one above the other to a shut off flow position wherein the openings in the upper metering plate 162 overlie solid portions in the lower metering plate 164 or vice versa thus preventing flow from the upper chamber 90 into the lower chamber 130. This condition obtains during the initial start up of an operating cycle in order to retain the sand in the upper chamber for a period of time to insure thorough mixing before discharge into the lower chamber. After this momentary time delay at start up, the upper metering plate 162 is rotated to move the openings out of the closed position into a partially open position of overlapping relation between the openings in the upper and lower plates and flow commences from the upper to the lower chamber. The flow rate is then regulated or metered by movements of the upper metering plate 162 and movement of the upper metering plate is accomplished by means of a radially depending lug 166 which extends downwardly thereof through one of the openings in the lower metering plate 164. A control arm 168 detachably connected to the lug and extends outwardly through a slot 169 in the lefthand wall segment 94 of the upper chamber wall as shown in FIG. 10. The outer end of the control arm is connected to a clevis on the outer end of a piston rod of a fluid cylinder 170 which is supported at the opposite end by a bracket 172 extending outwardly from the adjacent chamber wall section. Expansion and contraction of the effective length of the fluid cylinder 170 controls the relative position of the upper metering plate with respect to the lower metering plate and consequently controls the effective flow area available for the flow of material through the mixing chamber.

The lower metering plate 164 is formed in two portions which are generally semi-circular and are split apart from one another along a diametrical line 164*a* as best shown in FIG. 7. These half portions are supported around their outside peripheral edges by ribs 174 on the inside surfaces of the chamber wall segments 92 and 94 as shown in FIG. 10. In addition, there are provided inwardly extending support brackets 176 of generally trapezoidal shape having flat inner end faces 176*a* which bear against flats 178 on a square shaped centering plate which is carried on a support bearing 180 for the central portion of the rotor shaft 106.

Referring to FIG. 10, when the upper chamber wall sections 94 are closed, the surfaces 176*a* on the plate support brackets 176 bear against the flats 178 on the centering plate attached to the bearing 180 and this holds the bearing in a centered position for supporting the rotor shaft 106. Once the upper chamber 90 has been closed and latched and before the lower chamber 130 is mounted in place, suitable cap screws or other fasteners are extended upwardly from the support brackets 176 into aligned threaded openings in the halves of the lower metering plate 164 so that this plate does not rotate during operation. It will thus be seen that the engagement between the flat surfaces 176*a* and 178 when the upper chamber is closed, provides centering and support for the bearing 180 and the brackets 176 provide means along with the fasteners for securing the lower metering plate 164 against rotation. The selectively controlled rotation of the upper metering plate 162 is accomplished with the lug 166, the control arm 168 and the fluid cylinder 170 as previously described so that the flow of material from the upper chamber is accurately regulated during operation of the mixing apparatus.

It should be noted that the upper, cylindrical portion 134 of the lower chamber 130 is larger in diameter than the lower end or skirt of the upper chamber 90 and an annular closure plate 182 (FIG. 6) may be seated within a shoulder or recess internally formed on the portion 134 to close off the area between the adjacent portions of the upper and lower chambers.

In accordance with the present invention, one of the liquid components of the resin binder system to be used (normally the resin in a resin/catalyst system) is introduced into the mixing apparatus at a level just above the upper blade assembly 114 so that the resin and sand are thoroughly mixed as they travel downwardly along the wall liners 92*a* and 94*a* under the centrifuging action of the vertical edges of the upper blades 116. Similarly, a second or remaining component of the resin binder system (normally the catalyst) is introduced at an upper level in the lower mixing chamber section 130 just above the lower blade assembly 114 so that the resin/-sand mixture passing downwardly through the metering system 160 will be catalized and the resin thoroughly mixed with the catalyst by the time the finished mixture is ready for discharge at the cylindrical discharge outlet 140 at the lower end of the mixing chamber. In order to introduce the resin and catalyst in a highly efficient manner, the cylindrical transition section 82 and the cylindrical portion 134 of the lower chamber section 130 are formed with radially outwardly extending external bosses 184 having a radial bore, each adapted to accommodate a closed end nozzle 186 which is readily removable and which extends radially inwardly towards the rotor shaft 106 as shown in FIG. 7 during operation. At their outer ends, their nozzles are provided with couplings 188 for interconnection with respective resin and catalyst supply conduits 190 and 192. Referring to FIGS. 7 and 7*a*, the closed end nozzles 186 are provided with a plurality of longitudinally spaced apart discharge openings and the nozzles are orientated for discharging sprays of liquid downwardly at approximately a 45° angle as indicated by the arrows "G" (FIG. 7*a*) against the direction of movement of the swirling sand indicated by the arrow "H" in FIGS. 7 and 7*a*. This arrangement provides for thorough intermixing of the liquid resin and/or catalyst with the sand in the upper chamber 90 and the liquid catalyst and/or resin with the sand mixture in the lower chamber 130. In some binder systems, the catalyst may be introduced at the upper level and the resin at the lower level. The nozzle arrangement results in a thorough mixing action which is extremely efficient in terms of the amount of binder required to provide molding sand of the desired strength.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A mixing device for dispensing a mixture of molding sand and binder onto a mold forming pattern comprising:

a mixing chamber having an inlet for receiving sand adjacent an upper level and a discharge outlet for said mixture adjacent a lower level;

a rotor mounted to rotate on a downwardly extending, central axis of said chamber including an elongated shaft extending between said inlet and outlet;

metering means dividing said chamber into upper and lower sections for controlling the flow rate of material toward said outlet;

said rotor including upper and lower sets of longitudinally extending blades, means for pivotally mounting said upper and lower sets of blades on axes which are parallel to and spaced radially outwardly from said central axis, said sets of blades spaced respectively above and below said metering means, said blades including elongated free outer edges extending along and spaced inwardly of and in close proximity with an adjacent inside wall surface of said upper and lower sections of said chamber, respectively, when said outer edges are at maximum spacing from said central axis, for forcefully moving said mixture around said surface and mashing said material outwardly against the same with a layer of said mixture maintained between said blades and said inside wall surface.

2. The mixing device of claim 1 including injector means above said upper set of said blades for injecting a component of said binder into sand flowing downwardly into said upper set of blades.

3. The mixing device of claim 2 wherein said injector means includes a hollow tubular element extending inwardly from a wall section of said mixing chamber toward said rotor shaft and having a plurality of discharge openings therein at spaced intervals from said shaft directed to discharge said component in a downwardly sloping direction against direction of rotation of said blades.

4. The mixing device of claim 2 including second injector means below said metering means above said lower set of blades for injecting another component of said binder into the sand mixture flowing downwardly into said lower set of blades.

5. The mixing device of claim 4 wherein said second injector means includes a hollow tubular element extending inwardly from a wall section of said mixing chamber toward said rotor shaft and having a plurality of discharge openings therein at spaced intervals from said shaft directed to discharge said component in a downwardly sloping direction against direction of rotation of said blades.

6. The mixing device of claim 1 wherein said metering means includes a pair of metering plates concentrically mounted around said shaft and including flow openings formed at angularly spaced apart locations outwardly around the shaft and inwardly of said inside wall surface of said chamber, means for rotating said metering plates relative to one another for moving the respective openings therein into and out of registration to regulate the flow area available for the mixture moving downwardly from said upper chamber section toward said lower chamber section.

7. The mixing device of claim 6 including bearing means for supporting said rotor shaft intermediate its ends mounted adjacent the level of said metering plates.

8. The mixing device of claim 7 including support means around said inside wall surface of said chamber supporting an outer edge portion of one of said metering plates, adjacent the level of said bearing means.

9. The mixing device of claim 7 wherein one of said metering plates includes a central opening having a surface therein for centering said bearing means in said chamber.

10. The mixing device of claim 1 including a drive shaft in coaxial alignment with said rotor shaft and having a lower end spaced above said upper set of blades, and coupling means for removably interconnecting said drive shaft and said rotor shaft.

11. The mixing device of claim 1 wherein said upper chamber section includes a fixed wall segment and at least one movable wall segment pivotally interconnected there along a pivot axis outward and parallel of said central axis for movement between a closed position encircling at least a portion of said rotor and an open position exposing said rotor.

12. The mixing device of claim 11 including a pair of said movable wall segments pivotally interconnected along opposite edges of said fixed wall segment, said movable wall segments having outer edges movable toward and away from contacting engagement between a closed position and an open position.

13. The mixing device of claim 12 including releasable exterior latch means for positively latching said movable wall segments in said closed position.

14. The mixing device of claim 1 including wall liner means removably attached to said inside wall surface of said upper chamber section.

15. The mixing device of claim 1 wherein said lower chamber section is detachably interconnected with said upper chamber section.

16. The mixing device of claim 15 wherein said lower chamber section comprises a generally frusto-conically shaped hollow tubular casing sloping inwardly and downwardly from an upper end portion interconnected with said upper segment and terminating at a lower end of reduced diameter forming said discharge outlet.

17. The mixing device of claim 16 wherein said casing is a unitary member formed of synthetic resinous material.

18. The mixing device of claim 1 wherein said lower chamber section comprises a frusto-conically shaped hollow chasing tapering downwardly and inwardly from an upper end portion to an open lower end of a smaller diameter forming said discharge outlet, said blades of said lower set having a maximum dimension at their upper end radially outwardly of said shaft and tapering toward a minimum radial dimension at their lower end.

19. The mixing device of claim 18 wherein upper end portions of said blades of said lower set are curved adjacent their outer edges in a direction away from a radial plane opposite the direction of blade rotation for providing better smearing action of said mixture against the inside wall surface of said casing.

20. The mixing device of claim 1 wherein said lower chamber segment includes a large diameter upper portion spaced outwardly of a lower end portion of said upper chamber segment forming an annular air opening between said segments.

21. The mixing device of claim 20 wherein said lower chamber segment includes a frustro-conically shaped lower portion tapering inwardly and downwardly of said upper portion and open at a minimum diameter lower end forming said discharge opening.

22. The mixing device of claim 1 including a support structure for carrying said chamber to move around a work area as said mixture is dispensed, said structure including an articulated arm supporting said chamber at an outer end and including an inner end portion mounted for pivotal movement about an upright axis, and conveyor means extending along said articulated arm for supplying sand from a fixed location adjacent said upright axis to said inlet of said chamber.

23. The mixing device of claim 22 wherein said articulated arm includes a first section pivotal about said upright axis and including an outer end pivotally connected to a second section supporting said chamber at the outer end thereof, said conveyor means including a first section on said first section of said arm discharging into a second section on said second section of said arm, said second conveyor section discharging into said inlet of said chamber.

24. The mixing device of claim 23 wherein said conveyor sections comprise endless belts for carrying said sand, and means for funneling the discharge of sand from said first conveyor section onto the belt of said second conveyor section as said arm sections are pivoted with respect to one another.

* * * * *